US007481675B2

(12) United States Patent
Patterson et al.

(10) Patent No.: US 7,481,675 B2
(45) Date of Patent: Jan. 27, 2009

(54) CONNECTOR ASSEMBLY WITH CAVITY SEALING PLUG

(75) Inventors: Jeremy Christin Patterson, Greensboro, NC (US); Donald Robert Worthington, Pfafftown, NC (US); John Mark Myer, Millersville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/810,232

(22) Filed: Jun. 5, 2007

(65) Prior Publication Data

US 2008/0233784 A1 Sep. 25, 2008

Related U.S. Application Data

(60) Provisional application No. 60/919,393, filed on Mar. 22, 2007.

(51) Int. Cl.
*H01R 13/44* (2006.01)

(52) U.S. Cl. ..... 439/587; 439/148; 439/507

(58) Field of Classification Search ..... 439/148, 439/587, 507, 508–514

See application file for complete search history.

(56) References Cited

U.S. PATENT DOCUMENTS

| | | | | |
|---|---|---|---|---|
| 6,171,144 | B1 * | 1/2001 | Stone | 439/587 |
| 6,309,252 | B1 * | 10/2001 | Murakami et al. | 439/587 |
| 6,390,848 | B1 * | 5/2002 | Murakami et al. | 439/587 |
| 6,808,418 | B2 * | 10/2004 | Horner | 439/587 |
| 2001/0007802 | A1 * | 7/2001 | Horner | 439/588 |

* cited by examiner

*Primary Examiner*—Gary F. Paumen

(57) ABSTRACT

An electrical connector is shown having a housing having terminal receiving passageways, which receives a plurality of electrical terminals therein. The connector housing has a rear wire seal having a plurality of apertures at a rear face thereof for receiving terminals and a terminated conductor therethrough. At least one of the plurality of electrical terminal passageways is empty, and the sealing plug is positioned in the terminal receiving passageway to seal the cavity from the rear side thereof. The sealing plug also includes a latching surface for latching with the latch of the housing, and further provides a forward portion to deflect an installed shunt downwardly to prevent stubbing of a pin contact of a mating connector.

19 Claims, 13 Drawing Sheets

CONNECTOR ASSEMBLY WITH CAVITY SEALING PLUG

This application claims priority from Provisional Patent Application Ser. No. 60/919,393, the entirety of which is incorporated herein by reference.

FIELD OF THE INVENTION

The present invention generally relates to electrical connectors and more particularly to a connector assembly and a sealing plug therefore to seal empty terminal receiving passageways of one or more of the connector housings.

BACKGROUND OF THE INVENTION

Some conventional connector assemblies include a housing that houses an electrical terminal, where some of the terminal receiving cavities of one of the electrical connectors, particularly the socket housing, require an empty cavity, that is, where an electrical terminal is not loaded therein. In such cases, and when a rear seal is installed, a sealing plug can be inserted through the seal to seal the empty cavity. However, some of these connector assemblies include shunted contacts, and when the terminals are not loaded, the shunts themselves extend into the terminal receiving passageway adjacent to the front mating face and can cause stubbing while electrical connection is attempted with the pin header.

SUMMARY OF THE INVENTION

The present embodiment provides an electrical connector, comprising an insulative housing having a plurality of terminal receiving passageways extending between a mating face and a conductor exit face. A plurality of electrical terminals are positioned in at least some of the plurality of terminal receiving passageways, leaving at least one terminal receiving passageway empty. A sealing member is positioned adjacent to the plurality of terminal receiving passageways and have apertures to receive insulated conductors therethrough and seal an interior of the terminal receiving passageways. A sealing plug is received in the at least one empty terminal receiving passageway, and is latched therein, the sealing plug comprising a sealing section that fills the void of the sealing member aperture of the at least one empty terminal receiving passageway.

In another embodiment, an electrical connector, comprises an insulative housing having a plurality of terminal receiving passageways extending between a mating face and a conductor exit face. A plurality of electrical terminals are positioned in at least some of the plurality of terminal receiving passageways, leaving at least one terminal receiving passageway empty. A sealing member is positioned adjacent to the plurality of terminal receiving passageways and have apertures to receive insulated conductors thereto and seal an interior of the terminal receiving passageways. A sealing plug is received in the at least one empty terminal receiving passageway, the sealing plug comprising a sealing section that fills the void of the sealing member aperture of the at least one empty terminal receiving passageway, and further comprises an insulating socket adjacent to the mating face, for receiving therein, a pin contact of a mating connector.

In another embodiment, an electrical connector is profiled for connection with a complementary connector, the electrical connector comprises an insulative housing having a plurality of terminal receiving passageways extending between a mating face and a conductor exit face. A plurality of electrical terminals are positioned in at least some of the plurality of terminal receiving passageways, leaving at least one terminal receiving passageway empty. A sealing member is positioned adjacent to the plurality of terminal receiving passageways and have apertures to receive insulated conductors thereto and seal an interior of the terminal receiving passageways. An electrical shunt is positioned adjacent to at least two of the terminal receiving passageways. An insulating plug is received in the at least one empty terminal receiving passageway, and is profiled to deflect the shunt from a shunted to un-shunted position when received therein.

In yet another embodiment, a sealing plug is receivable within an empty terminal receiving passageway of a sealed electrical connector, and comprises an elongate body profiled to be received in at least one empty terminal receiving passageway. The sealing plug comprises a sealing section that fills the void of a sealing member aperture of the at least one empty terminal receiving passageway, and the elongate body is profiled to extend to a position adjacent to a mating face of the sealed electrical connector.

The above mentioned and other features of this invention, and the manner of attaining them, will become more apparent and the invention itself will be better understood by reference to the following description of embodiments of the invention taken in conjunction with the accompanying drawings.

DETAILED DESCRIPTION OF THE EMBODIMENT

Figure 1:
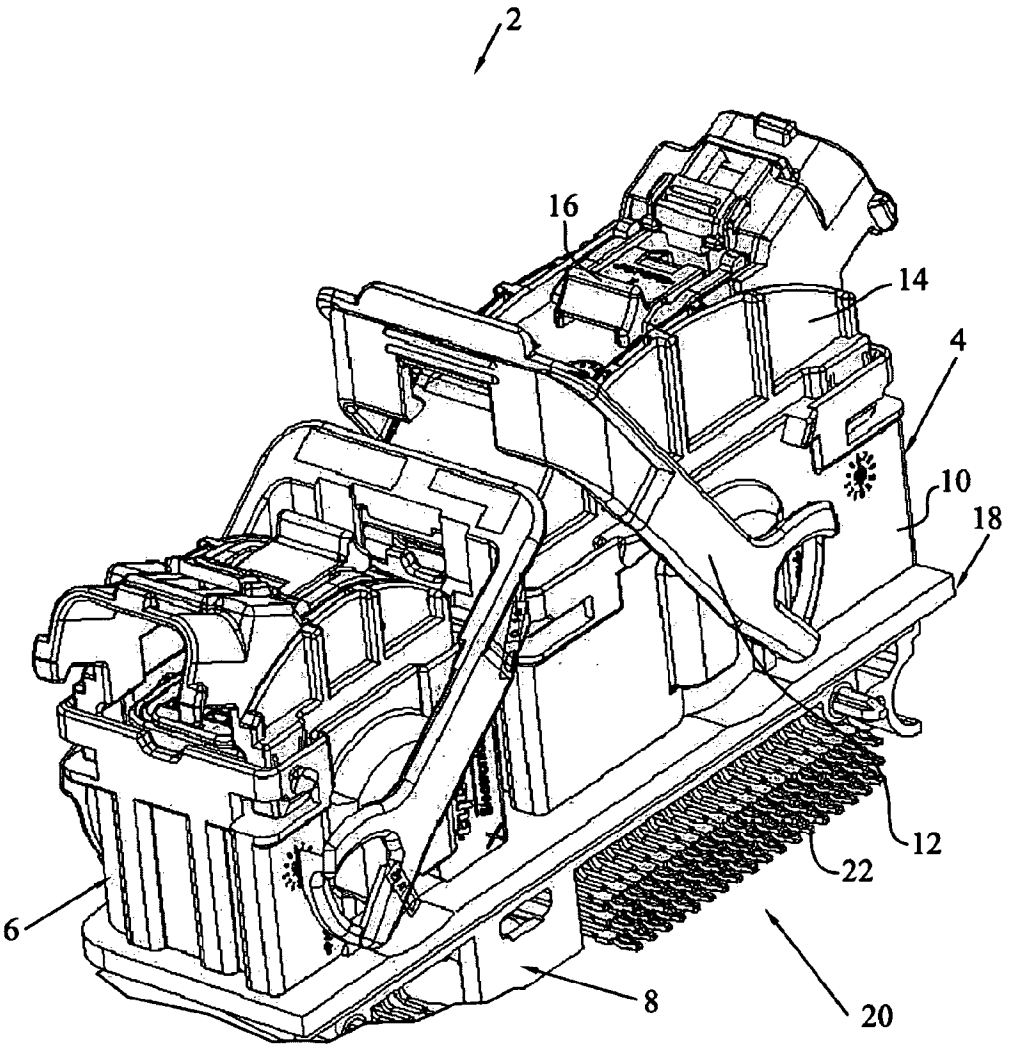
FIG. 1 shows a top perspective view of the electrical connector assembly of the present invention.

The embodiments disclosed below are not intended to be exhaustive or to limit the invention to the precise forms disclosed in the following detailed description. Rather, the embodiments are chosen and described so that others skilled in the art may utilize their teachings.

Corresponding reference characters indicate corresponding parts throughout the several views. Although the drawings represent embodiments of the present invention, the drawings are not necessarily to scale and certain features may be exaggerated in order to better illustrate and explain the present invention.

With reference first to FIG. 1, an electrical connector assembly is shown generally as 2 which comprises first and second plug connectors 4 and 6, both of which are electrically connected to a header connector 8. Each of the plug connectors 4 and 6 are virtually identical, except for their relative size and number of electrical terminals within the connectors. Therefore, only one of the plug connectors will be described in detailed. It should be understood that header connector 8 is only illustrative, and that any form of connector system could be incorporated herein, for example, a single plug/header connector assembly shown in provisional application 60/919,437, (the disclosure of which is fully incorporated herein by reference) or any in-line style connectors or various connectors with different terminal arrays.

As shown in FIG. 1, plug connector 4 is generally comprised of a plug housing 10, having a mating assist member 12 in the form of a lever, which straddles plug housing 10 and is rotatable in the clockwise and counterclockwise sense to move the connector into and out of mated conditions as is known in the art. The plug connector 4 further comprises a wire dress cover 14 having a connector position assurance member 16. Header connector 8 is comprised of a housing 18 having a plurality of pin contacts 20 with a plurality of printed circuit board contacts 22 shown in FIG. 1.

Figure 2:
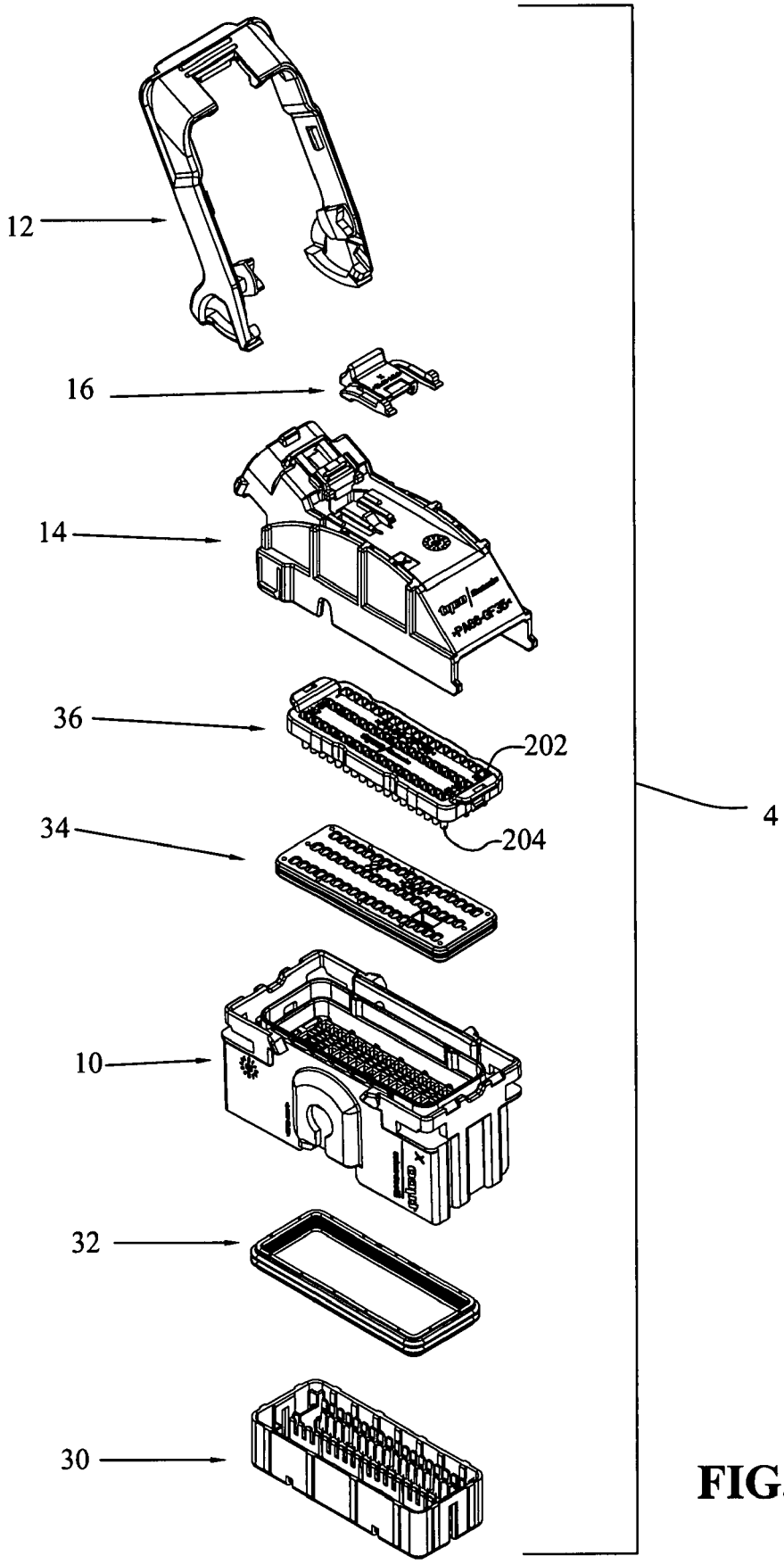
FIG. 2 shows an exploded view of one of the plug connectors of the present invention.

With respect to FIG. 2, most of the components of plug connector 4 are shown in an exploded manner, and include a terminal position assurance member 30, peripheral seal 32, plug housing 10 as mentioned above, a wire seal 34, a seal cover 36, wire dress cover 14, connector position assurance member 16 and mating assist member 12. The assembly would further comprise a plurality of electrical terminals 140 (FIG.10), one or more shunting members 150 (FIG. 11), and one or more sealing plugs 250 (FIG. 17) to seal individual terminal receiving passageways, when the passageways are not fully loaded with terminals. With the components as generally outlined above, each of the components will now be described in greater detail.

Figure 3:
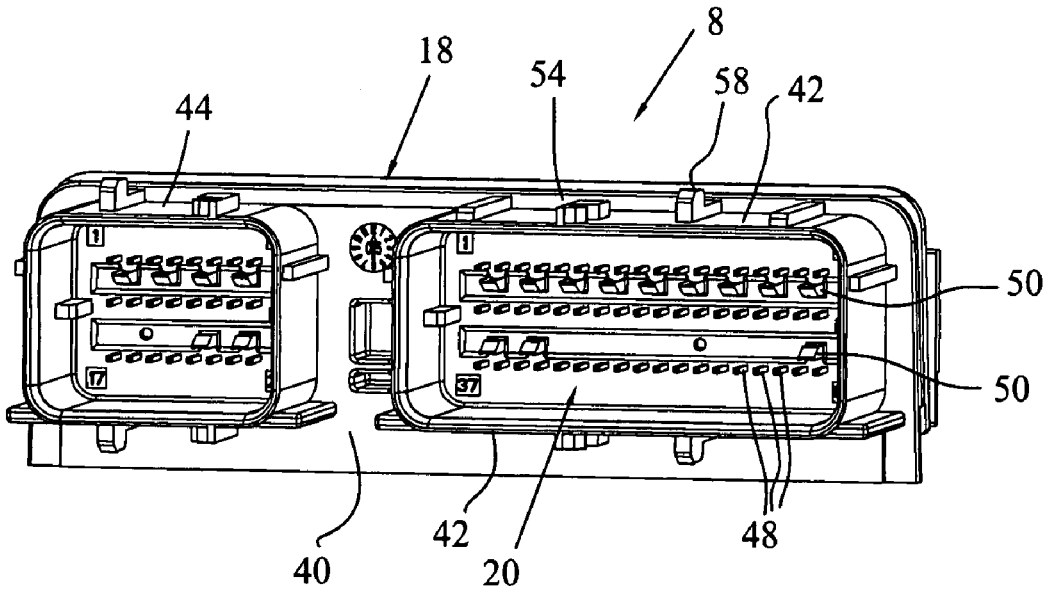
FIG. 3 shows a front perspective view of the header connector of the present invention.
Figure 4:
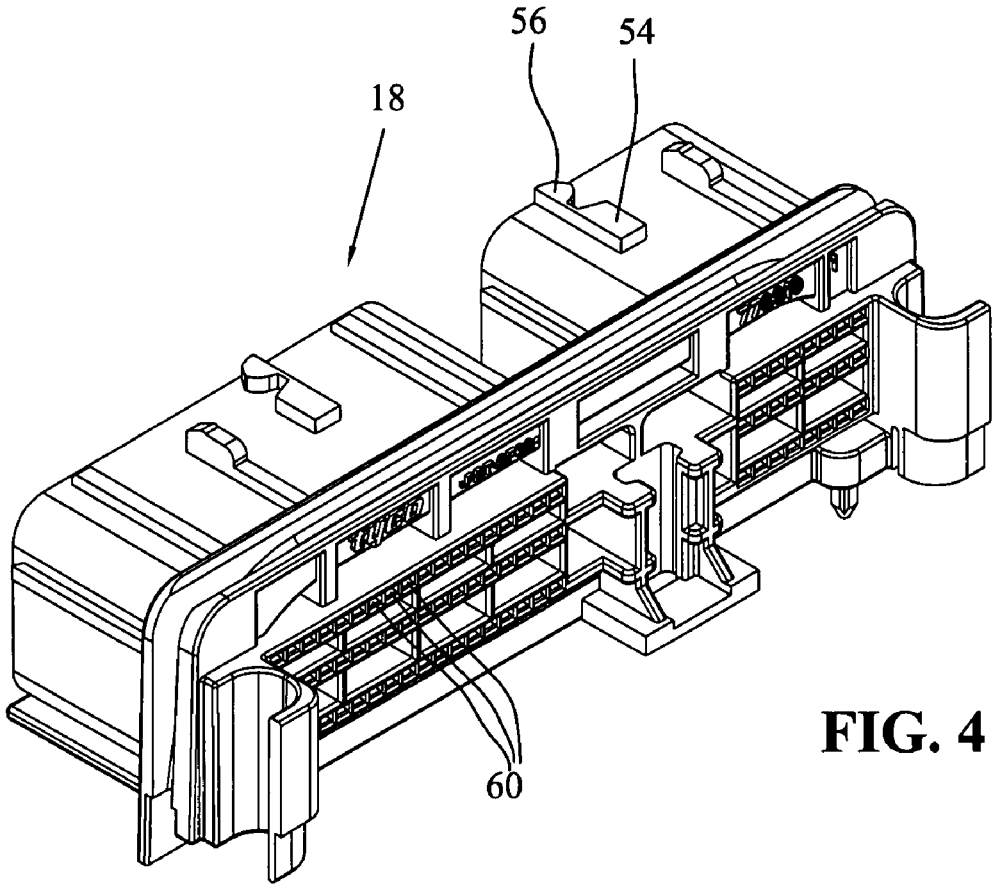
FIG. 4 shows a rear perspective view of the header connector of FIG. 3.

With reference now to FIGS. 3 and 4, header connector 8 is shown where housing 18 is generally comprised of a front wall 40 having first and second shrouds 42, 44, which correspond in size with plug connectors 4 and 6, respectively. Shroud 42 surrounds and protects the plurality of contacts 20, which as viewed in FIG. 3, also include pin terminals 48, which as should be appreciated to those skilled in the art, are connected to printed circuit board contacts 22 described above. Extending intermediate some of the pin terminals 48 are cam members 50, which operate a shunt member 150 within the plug connector 4, as will be described in further detail herein. With respect to FIG. 4, a plurality of apertures are provided at 60 for receipt therethrough of the plurality of contacts 20.

Figure 5:
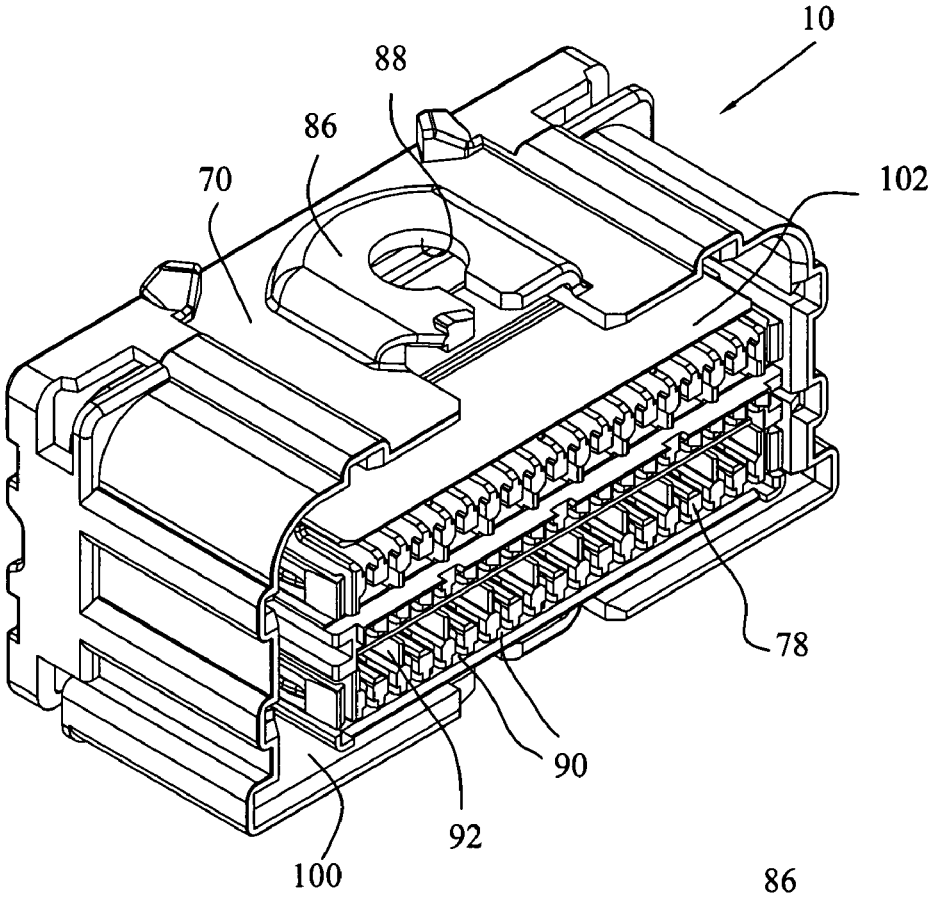
FIG. 5 shows a front perspective view of the plug housing of the present invention.
Figure 6:
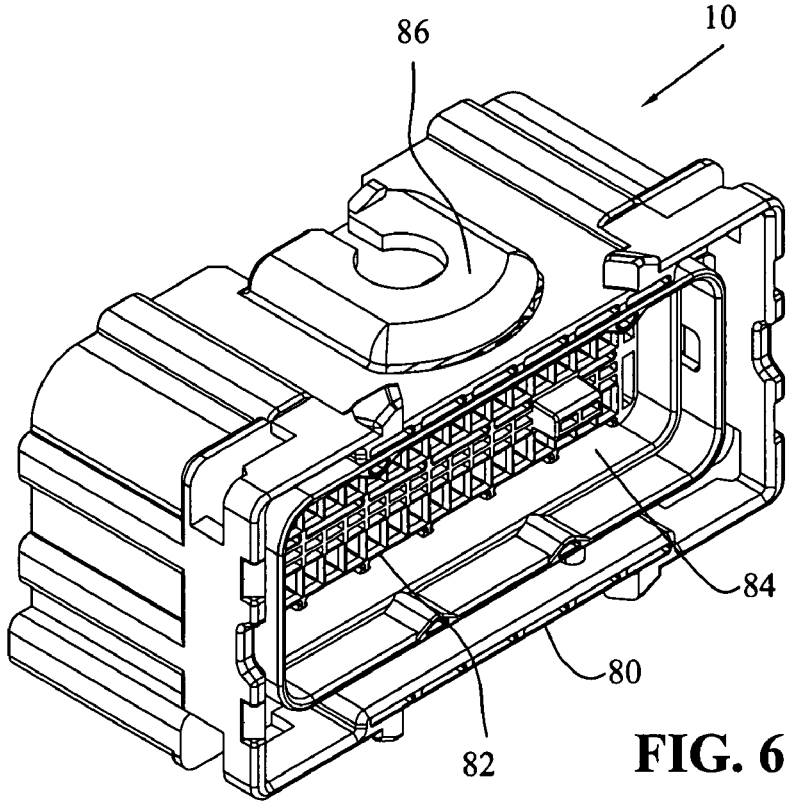
FIG. 6 shows a rear perspective view of the plug housing of FIG. 5.
Figure 7:
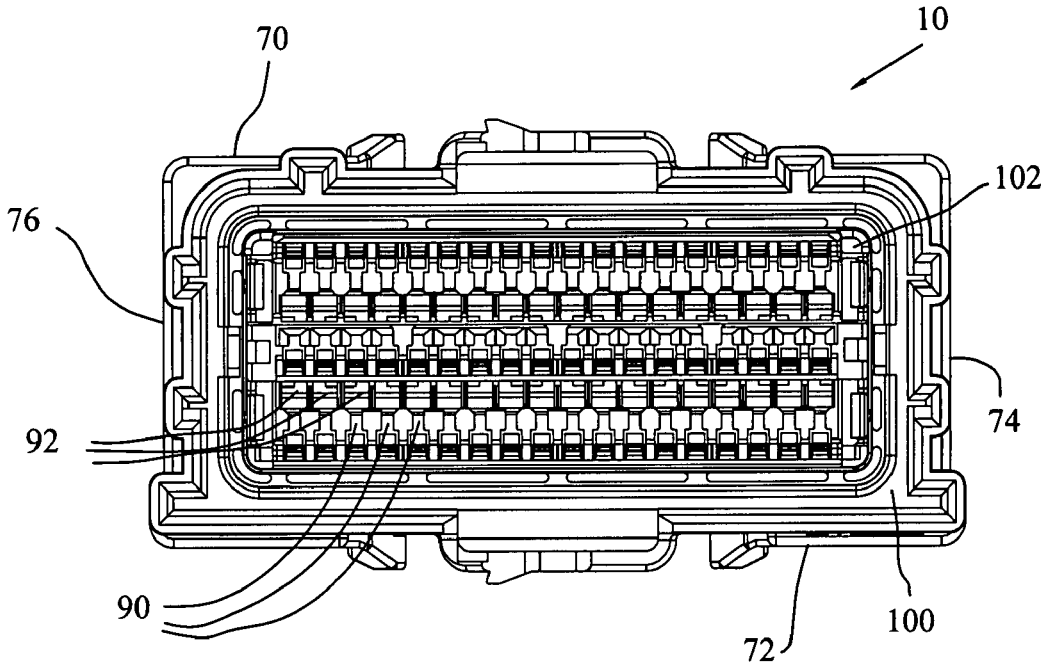
FIG. 7 shows a front plan view of the plug housing of FIG. 5.

With reference now to FIGS. 5-7, plug housing 10 will now be described. With respect first to FIG. 7, plug housing 10 is generally comprised of a top wall 70, lower wall 72, side wall 74, and side wall 76. Plug housing 10 also includes a front face at 78 (FIG. 5). As shown in FIG. 6, plug housing 10 includes a rear face 80, an inner face 82 against which wire seal 34 will be received, and a sealing surface 84. As shown best in FIG. 5 or 6, side walls 70 and 72 include a raised wall at 86 which provides a keyhole aperture 88 for receipt of the lever.

Also as best shown in FIG. 7, plug housing 10 includes a plurality of terminal receiving passageways 90 with a plurality of shunt openings 92, where one of the shunt openings 92 spans at least two terminal receiving passageways 90, as described further herein. As best shown in FIGS. 5 and 7, walls 70-76 form an outer shroud for plug housing 10 with a peripheral channel 100 surrounding inner housing portion 102. As should be expected, peripheral channel 100 is profiled to be received over shroud 42 (FIG. 3) for interconnection of plug connector 4 with header connector 8 as further described herein.

Figure 8:
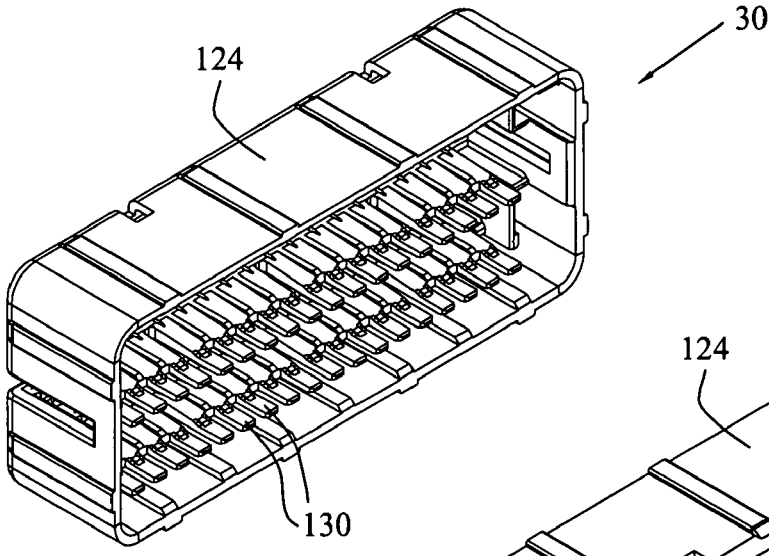
FIG. 8 shows a rear perspective view of the terminal position assurance member of the present invention.
Figure 9:
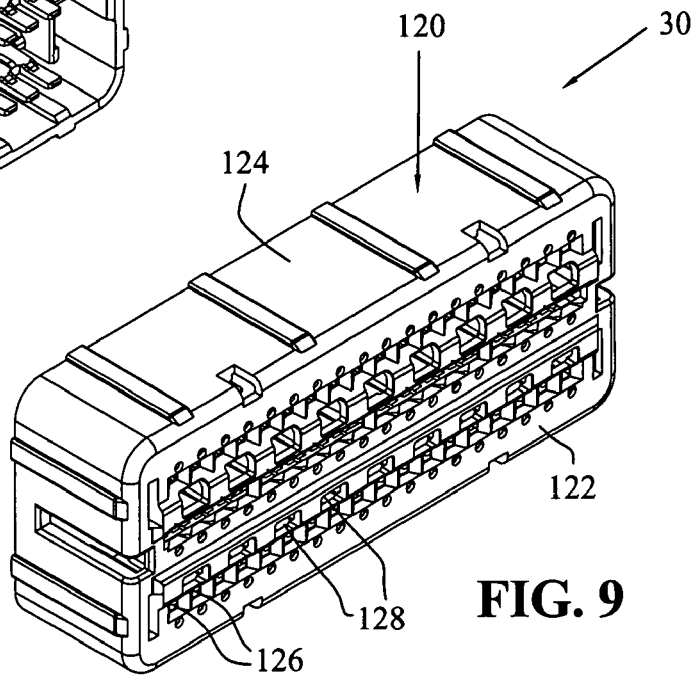
FIG. 9 shows a front perspective view of the terminal position assurance member of FIG. 8.

With reference now to FIGS. 8 and 9, terminal position assurance member 30 is shown as comprised of an insulative body 120 having a front face 122 and a peripheral shroud 124. As described herein, front face 122 defines the front mating face of the plug connector 4. A plurality of apertures 126 extend therethrough which will align with apertures 90 (FIG. 7) of plug housing 10. A plurality of access ports 128 are provided which laterally overlap apertures 126 and are profiled to align with apertures 92 (FIG. 7) as further described herein. Finally as shown in FIG. 8, terminal position assurance member 30 includes a plurality of back-up tines 130 is shown to assure a latching condition of contacts as described herein.

Figure 10:
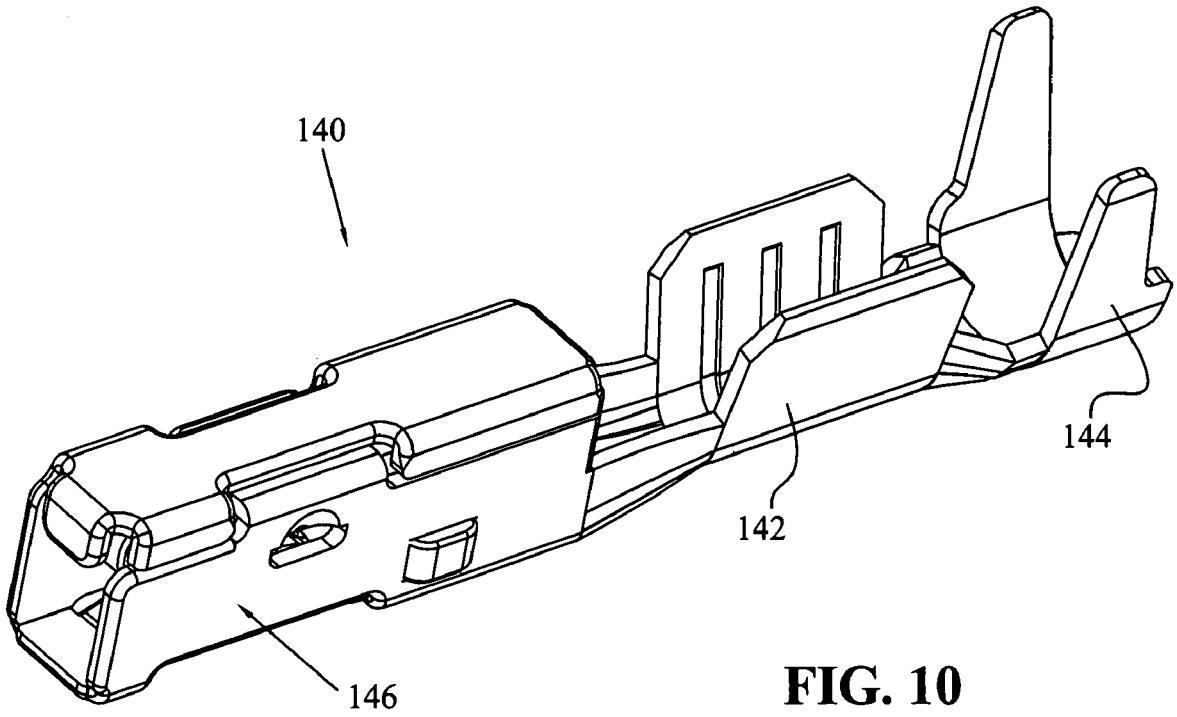
FIG. 10 shows a perspective view of the electrical terminal for use in the present invention.

With reference now to FIG. 10, an electrical terminal is shown as 140 which includes a wire crimp 142, strain relief 144 and a front socket portion 146 for contact with pin terminals 48 (FIG. 3) as further described herein. It should also be noted that terminal 140 is substantially the same as that described in Applicants' Patent Application Publication No. 2007/0021013 published on Jan. 25, 2007, the disclosure of which is fully incorporated herein by reference. However, as known to those skilled in the art, other terminal configurations are suitable for use with the electrical shunt member of the present invention.

Figure 11:
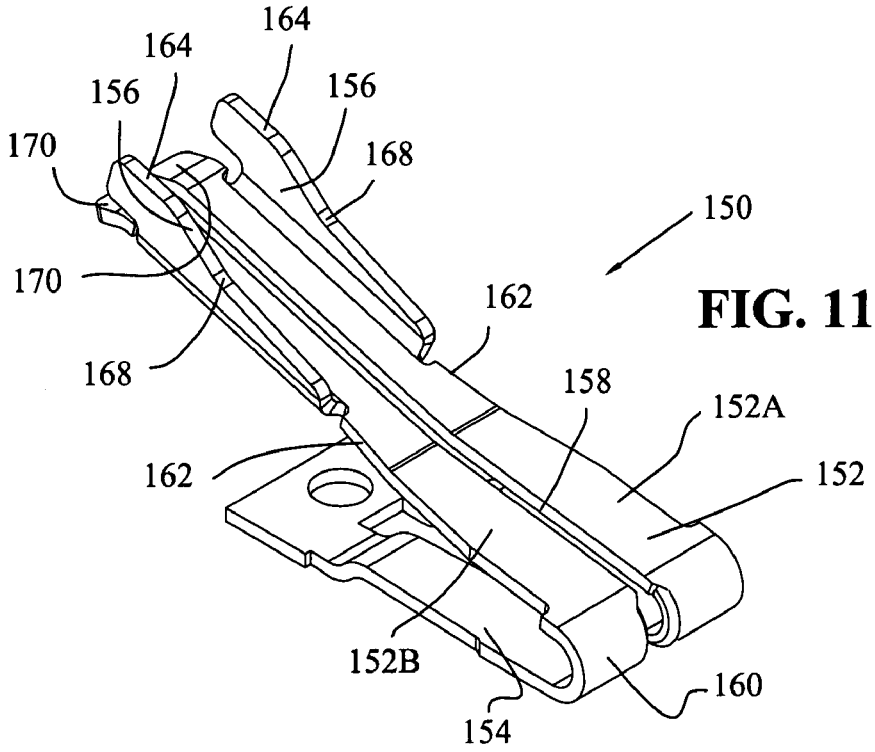
FIG. 11 shows a top perspective view of the electrical shunt member of the present invention.

With reference now to FIG. 11, an electrical shunt member 150 is shown which is comprised of a cantilever beam 152, a base portion 154 and shunt contacts 156. Cantilever beam 152 has a longitudinal seam at 158 to form two independent sections 152A and 152B. As shown, base portion 154 and cantilever beam 152 are reversely bent about a bight portion 160 where longitudinal seam 158 extends through the reverse bend of bight portion 160. Each of the shunt contacts 156 is formed by folding up the contacts 156 in an upstanding manner from side edges 162 of each of the sections 152A, 152B. Each of the shunt contacts 156 includes an upper contact edge at 164 and an angled edge 168, which is defines as a camming edge. Angled edge 168 increases at an angle upwardly from the rear towards the front. Finally, as also shown in FIG. 11, each of the sections 152A, 152B includes deflecting plates 170, adjacent the front edge thereof, and are angled downwardly towards the base portion 154. Shunt member 150 and its operation is more fully described in our commonly filed, co-pending application Ser. No. 11/810,288, the disclosure of which is fully incorporated herein by reference.

Figure 12:
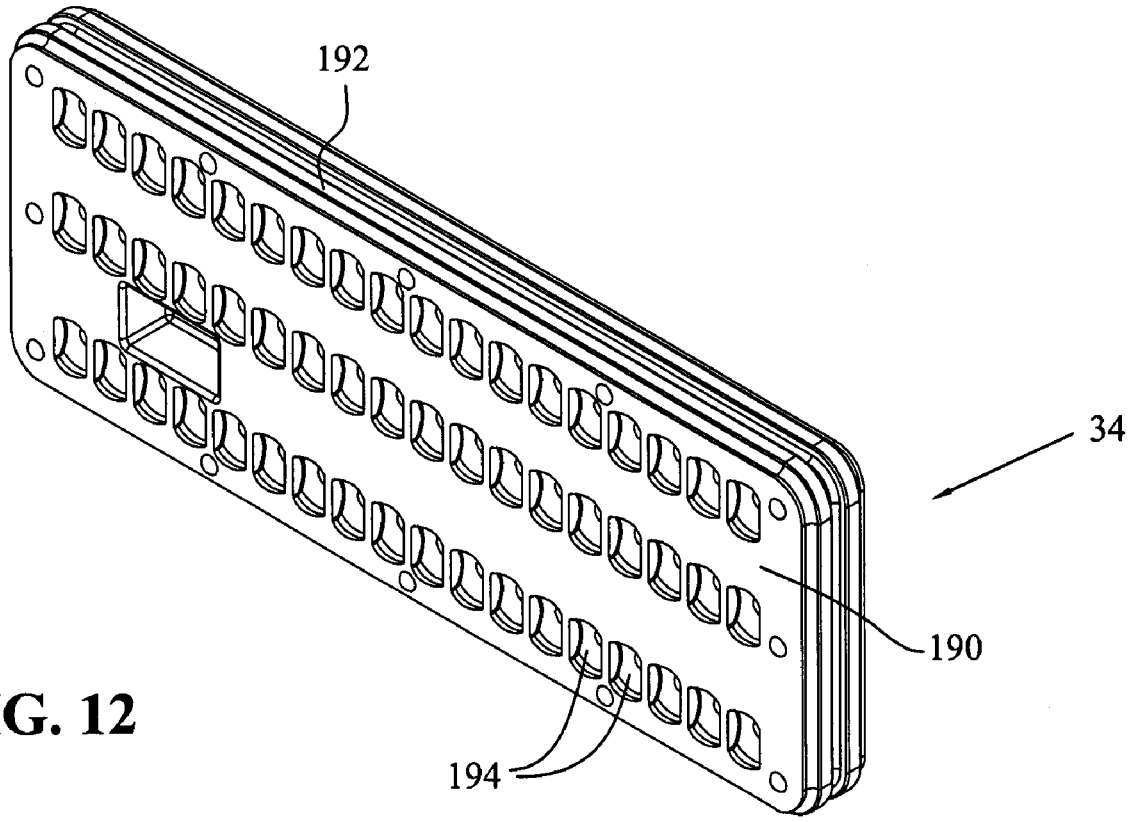
FIG. 12 shows a perspective view of the wire seal used in the present invention.

With respect now to FIG. 12, wire seal 34 is shown which is comprised of a substantially solid sealing material in the form of a body 190 having outer peripheral ribs at 192, and a plurality of apertures at 194 profiled to receive therethrough electrical terminals 140. It should be appreciated that each of the apertures 194 aligns with apertures 90 (FIG. 7) of plug housing 10, and apertures 126 (FIG. 9) of terminal position assurance member 30.

Figure 17:
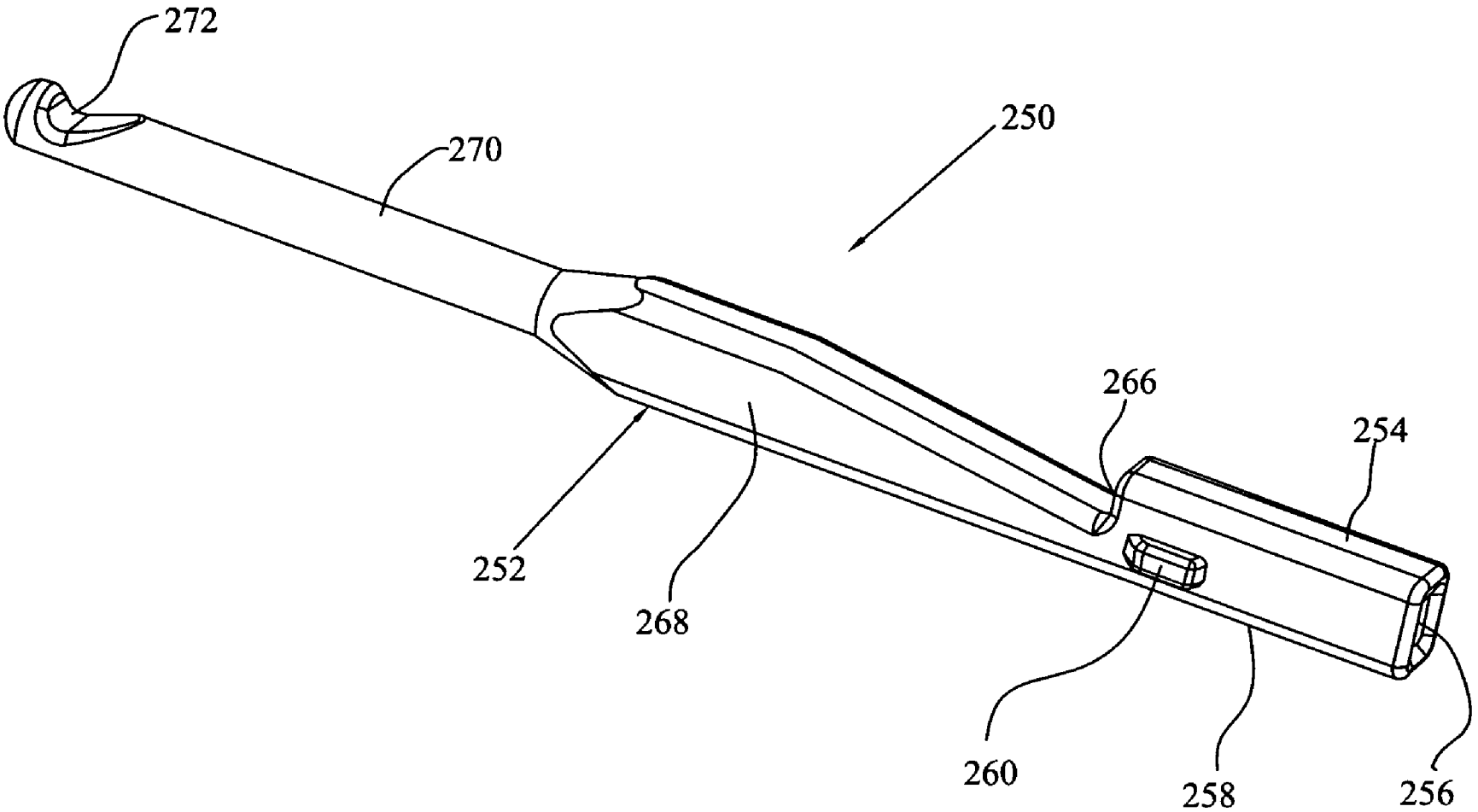
FIG. 17 shows a perspective view of the sealing plug.

As mentioned above, some of the terminals may need to be left out of the plug housing 10. In such a situation, that passageway needs to be plugged. As shown in FIG. 17, a sealing plug is shown as 250 which is receivable into the passageway 90. It is generally comprised of an elongate body member 252, having a forward portion 254 which simulates a socket contact and includes a pin receiving aperture 256 therein. The portion 254 also includes a contact surface 258, and polarizing lugs 260 to polarize the sealing plug within the terminal receiving passageways 90. A latching surface 266 is defined between the forward portion 254 and an intermediate portion 268. Finally the opposite end includes an extension member 270 which provides a sealing surface as described herein. A finger grip portion 272 is defined at the end of the extension portion 270 for an operator to grip the sealing plug for its removal.

Figure 13:
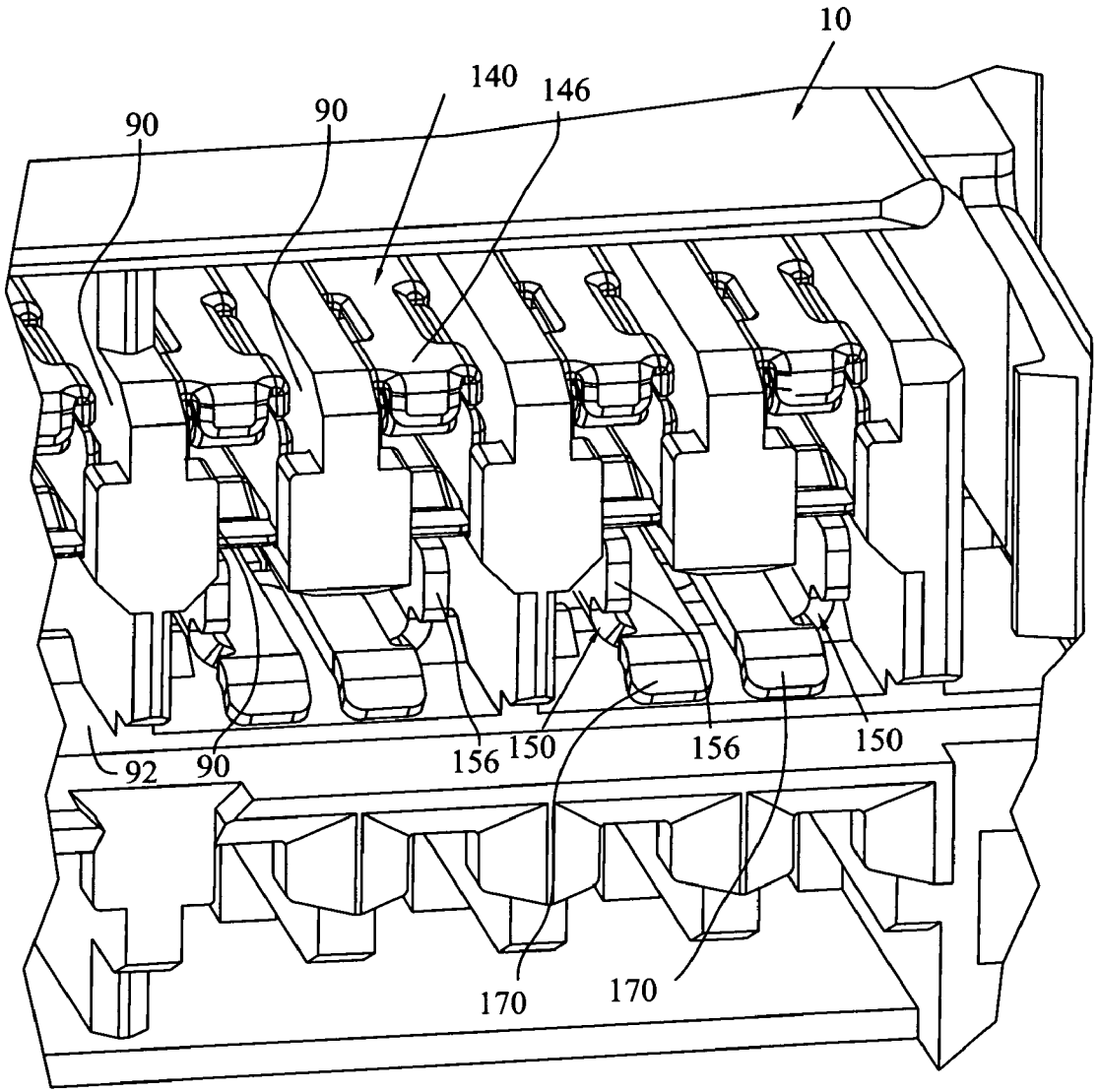
FIG. 13 shows a fragmented perspective view showing the electrical shunt member and the electrical terminals positioned in the plug housing without the terminal position assurance member in place.
Figure 15:
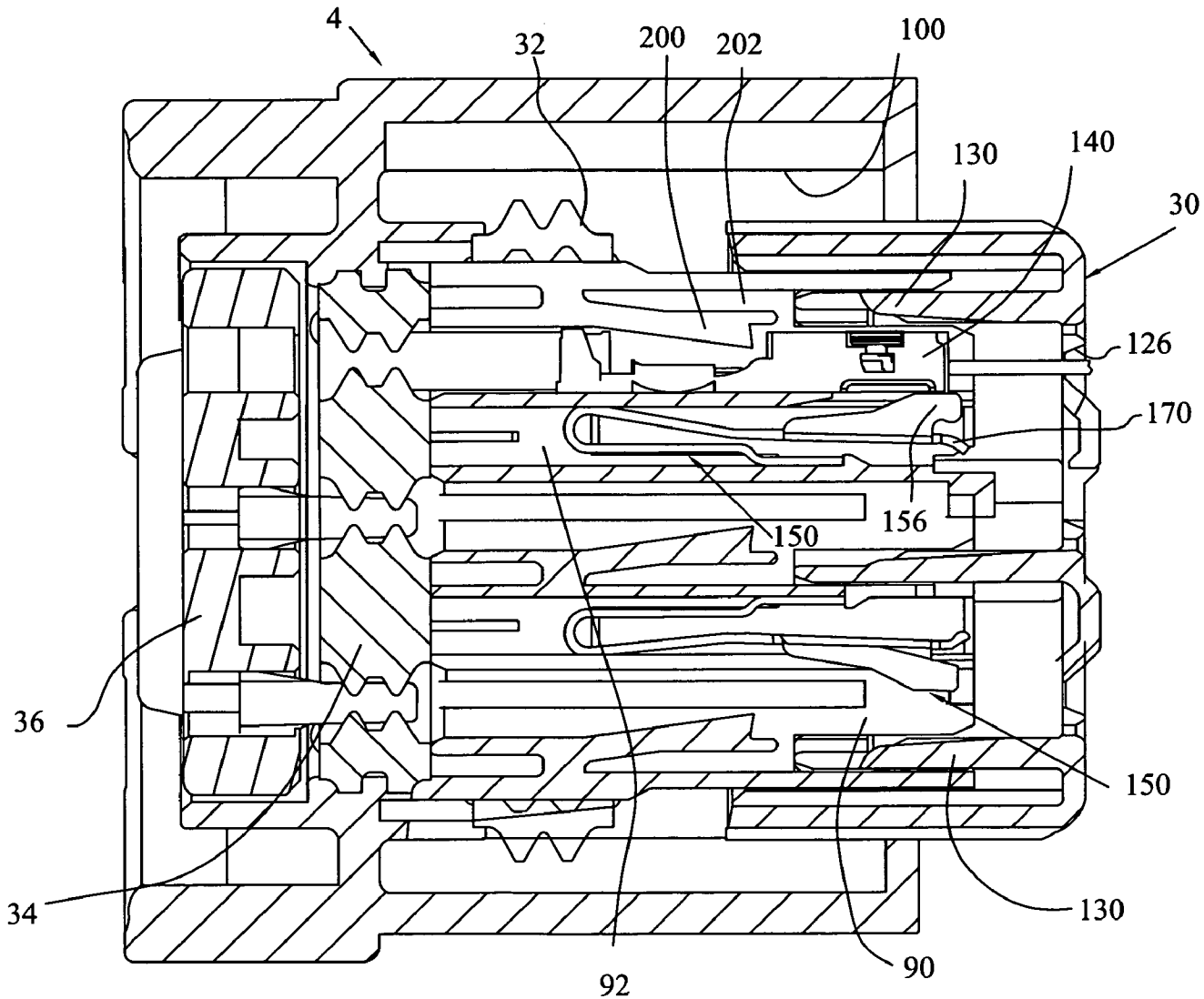
FIG. 15 shows a longitudinal cross-sectional view of the assembled plug housing, through two of the terminal receiving passageways, prior to connection with the header connector.

With all of the individual components described, the assembly of the assembly 2 will now be described. To assemble the plug connector 4, the plug members 204 are removed for each terminal receiving passageway 90 receiving a terminal 140. In some cases, plug members 204 (FIG. 2) are removed, and sealing plugs 250 are positioned within the terminal receiving passageways 90. The electrical terminals 140 are then positioned within their respective terminal receiving passageways 90, through apertures 202 (FIG. 2) of seal cover 36, as best shown in FIGS. 13 and 15, and shunt members 150 are received in their respective passageways 92. As situated therein, each of the shunt contacts 156 of a single electrical shunt member 150 contacts adjacent electrical terminals 140 in adjacent passageways 90. It should also be appreciated that the passageways 92 and the electrical shunt member 150 could be profiled to span one or more passageways 90 and shunt nonadjacent electrical terminals 140. Also due to the fact that the shunt member 150 has independent sections 152A and 152B, the shunt contact could be programmed to selectively move (or not move) to an unshunted position. It should also be appreciated that more than two shunt contacts 156 could be incorporated to, shunt more than two contacts.

With the assembly of the electrical connector assembly described, the operation of the embodiment will now be described. The operation of the shunt member 150 with a terminal 140 will first be described to show the interaction between the two. The operation of the sealing plug 250 will then be described to show the operation when a terminal 140 is selectively removed.

Figure 14:
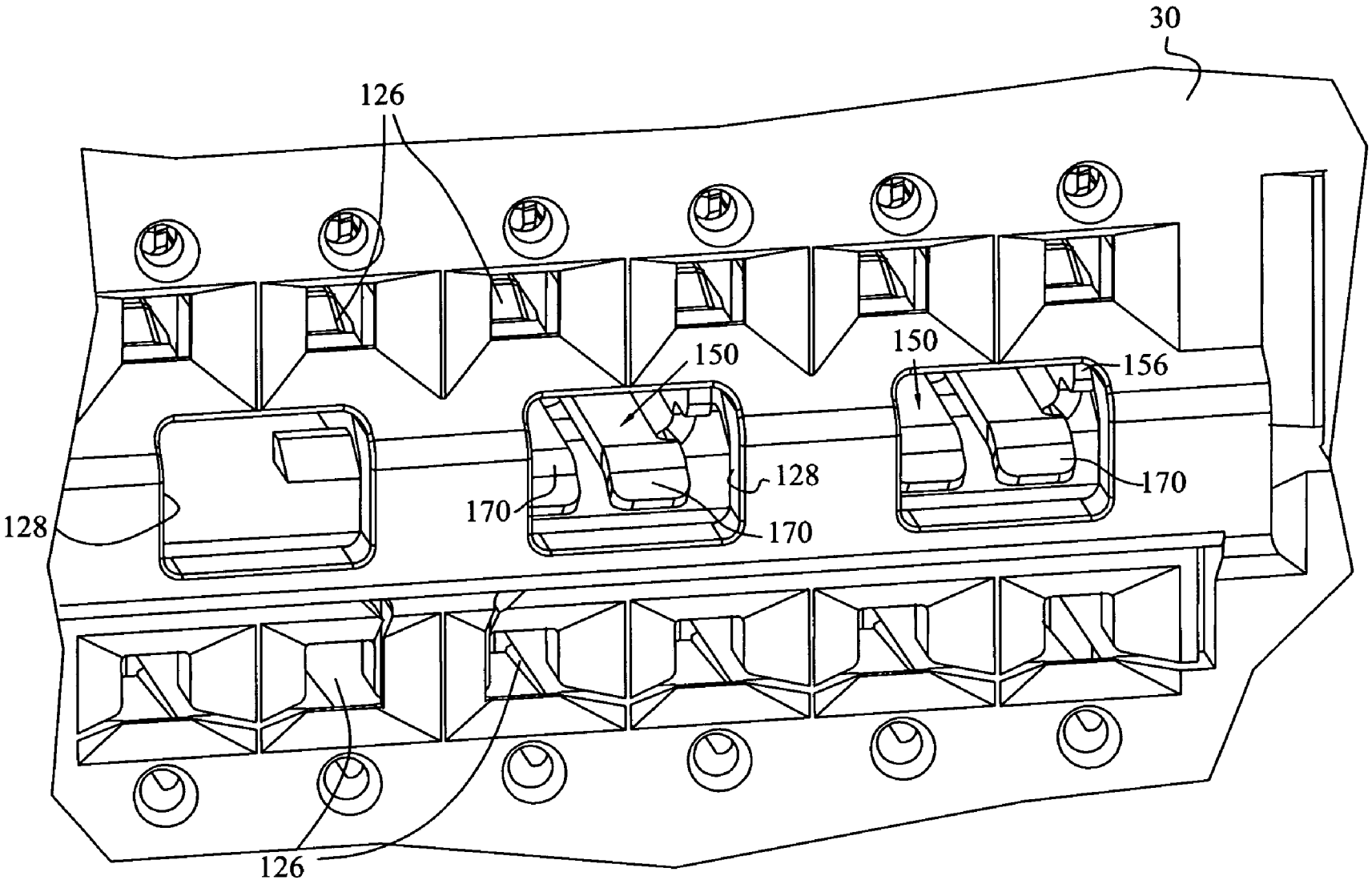
FIG. 14 is a view similar to that of FIG. 13 showing the terminal position assurance member in place.

With reference first to FIG. 14, the terminal position assurance member 30 is shown positioned over plug housing 10(when in the condition shown in FIG. 13) and access ports 128 are shown aligning with individual electrical shunt members 150, and in particular with deflecting plates 170. Access ports 128 are also aligned with cam members 50 of header connector 8. Furthermore, apertures 126 are aligned with socket contact portions 146 of electrical terminals 140.

FIG. 15 shows a longitudinal cross-sectional view through the assembled plug connector 4 where the terminal position assurance member 30 is in a pre-locked condition, for receipt of electrical terminals 140. In this position, back-up tines 130 are not yet positioned behind resilient latch arms 200. As is known in the art, the terminal position assurance member 30 is moveable to the left (as viewed in FIG. 15) such that tines 130 fill gap 202 and backup the latch arm 200 to prevent deflection thereof.

As also shown in FIG. 15, peripheral seal 32 is shown in a surrounding relation around inner housing portion 102 of plug housing 10, and as shown, is profiled to seal an interior thereof within peripheral channel 100. Furthermore, wire seal 34 and seal cover 36 are shown in position against the rear of plug housing 10. As also shown, shunt member 150 is shown fully positioned within shunt passageways 92 and shunt contact 156 is shown spring-loaded against electrical terminal 140.

With respect again to FIG. 1, to make electrical connection between plug connector 4 and header connector 8, the lever 12 is placed in the position shown in FIG. 1, and the plug connector 4 is aligned with peripheral channel 100 overlying shroud 42. Lever 12 can then be rotated to the right (clockwise) such that the rotation of lever 12, moves the connector pair 4, 8 into full electrical engagement. The full engagement is shown in FIG. 16.

Figure 16:
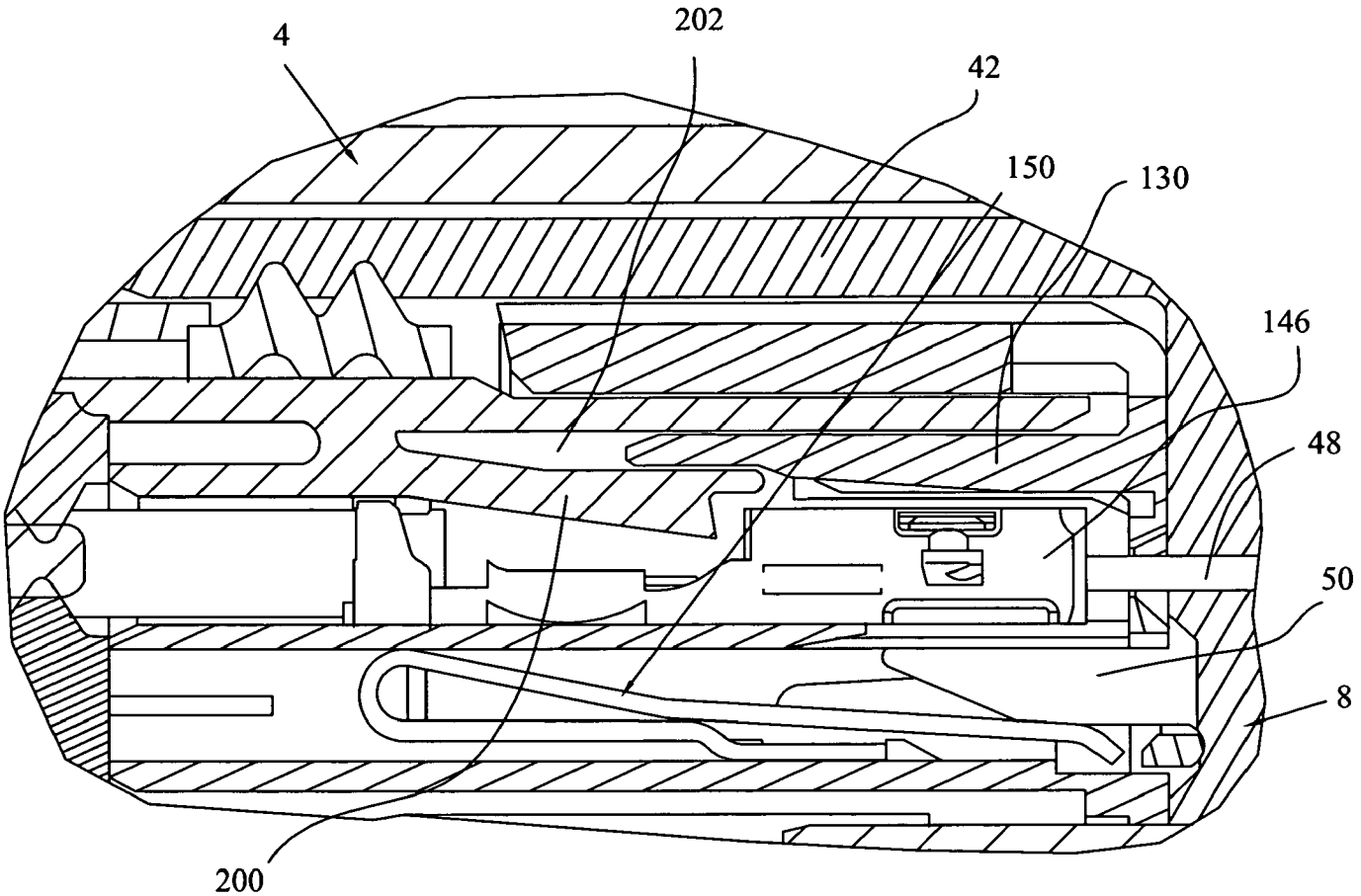
FIG. 16 shows a cross-sectional view similar to that of FIG. 15 showing the header connector in position.

As shown in FIG. 16, pin terminals 48 are positioned within socket portions 146 of electrical terminals 140, cam members 50 have deflected shunt member 150 out of shunting relation with electrical terminals 140, and tines 130 have moved to their fully forward position enclosing the gap 202 preventing deflection of latch 200.

Figure 18:
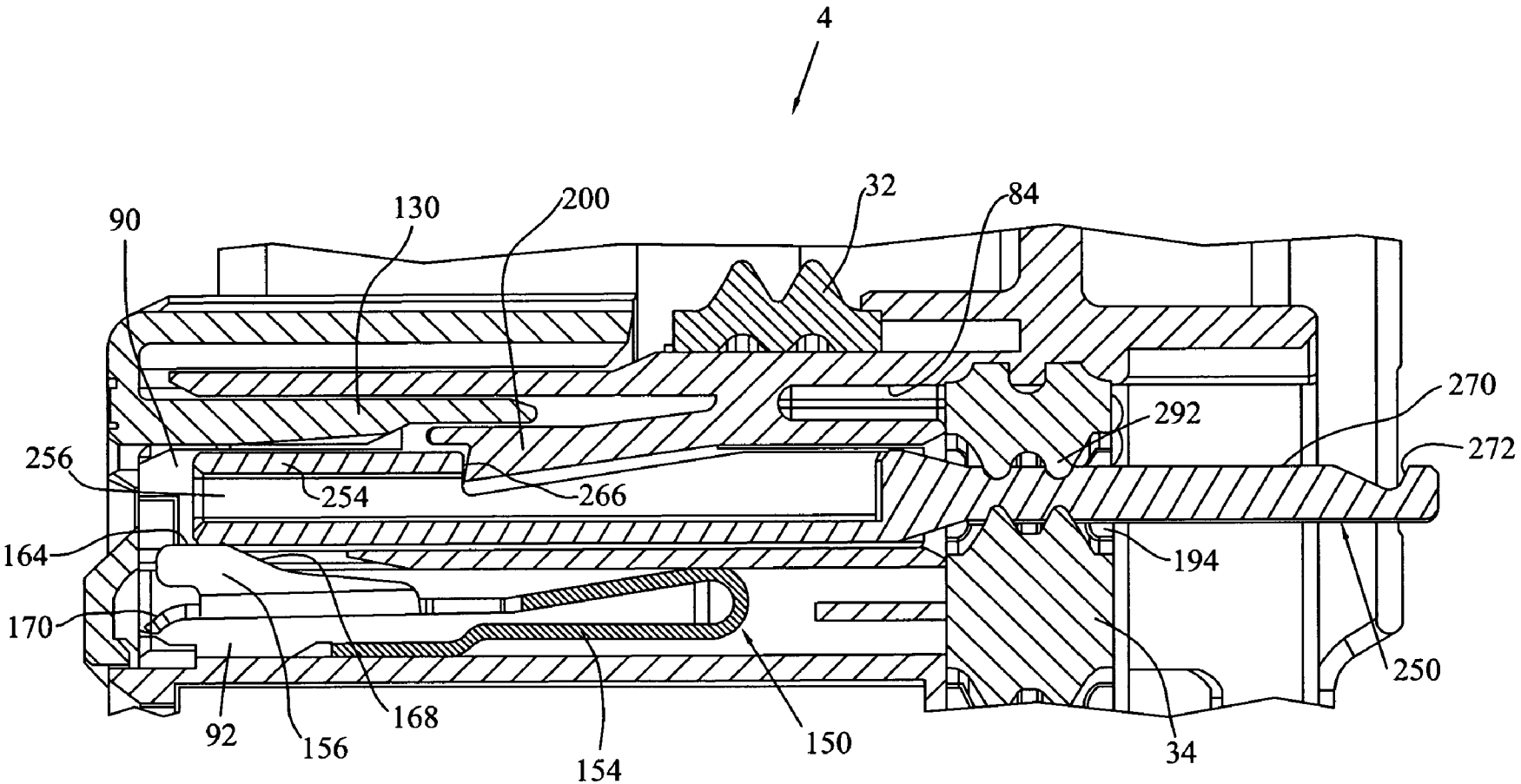
FIG. 18 is a longitudinal cross sectional view similar to that of FIG. 15, with a sealing plug, filling the terminal receiving passageway.

However, in the event that one or more of the terminals 140 need to be removed for proper electrical operation of the assembly 2, then sealing plug 250 is positioned in the passageway 90 in place of terminal 140. With respect to FIG. 18, sealing plug 250 is shown in its fully inserted position with forward portion 254 positioned adjacent to the front face 78, and with latch 200 engaged with surface 266 of sealing plug 250. As shown in the fully installed position of FIG. 18, sealing plug 250 is also shown deflecting shunt contact 156 downwardly which prevents stubbing of a pin terminal upon insertion into the empty cavity. As also shown, extension portion 270 is shown extending through aperture 194 of seal 34 with sealing ribs 292 engaged against the surface. Finger grip 272 is shown proud of the housing for removal of sealing plug 250.

Thus, as shown, sealing plug 250 may be inserted into an empty passageway 90 to take the place of a terminal 140. Extension portion 270 provides a surface against which sealing ribs 292 may seal, and portion 254 engages shunt contact 156 to move it out of the passageway 90. Furthermore sealing plug 250 may also be latched in place without changing the plug housing 10, in that latch,200 is used to latch against surface 266.

What is claimed is:

1. An electrical connector, comprising:

an insulative housing having a plurality of terminal receiving passageways extending between a front face and a conductor exit face;

a plurality of electrical terminals positioned in at least some of said plurality of terminal receiving passageways, leaving at least one terminal receiving passageway empty;

a sealing member positioned adjacent said plurality of terminal receiving passageways and having apertures to receive insulated conductors therethrough and seal an interior of the terminal receiving passageways; and a sealing plug, profiled to be received in said at least one empty terminal receiving passageway, and be latched therein, said sealing plug comprising a sealing section that fills the void of the sealing member aperture of the at least one empty terminal receiving passageway;

wherein said insulative housing comprises a latch extending into the envelope of the terminal receiving passageway, and said sealing plug has a surface for engagement with said latch.

2. An electrical connector of claim 1, wherein said sealing plug further comprises an insulating socket adjacent to the mating face, for receiving therein, a pin contact of a mating connector.

3. An electrical connector of claim 1, further comprising an electrical shunt member positioned adjacent to at least two of said terminal receiving passageways, and said sealing plug is profiled to deflect said shunt member from a shunted to un-shunted position when received therein.

4. An electrical connector of claim 1, wherein said sealing plug has an extension portion extending beyond said sealing member.

5. An electrical connector of claim 4, wherein said extension portion has a finger grip for gripping said sealing plug.

6. An electrical connector, comprising:

an insulative housing having a plurality of terminal receiving passageways extending between a front face and a conductor exit face;

a plurality of electrical terminals positioned in at least some of said plurality of terminal receiving passageways, leaving at least one terminal receiving passageway empty;

a sealing member positioned adjacent said plurality of terminal receiving passageways and having apertures to receive insulated conductors therethrough and seal an interior of the terminal receiving passageways; and a sealing plug, profiled to be received in said at least one empty terminal receiving passageway, said sealing plug comprising a sealing section that fills the void of the sealing member aperture of the at least one empty terminal receiving passageway, and further comprising an insulating socket adjacent to the mating face, for receiving therein, a pin contact of a mating connector.

7. An electrical connector of claim 6, further comprising an electrical shunt positioned adjacent to at least two of said terminal receiving passageways, and said sealing plug is profiled to deflect said shunt member from a shunted to un-shunted position when received therein.

8. An electrical connector of claim 6, wherein said sealing plug is profiled for latching within said terminal receiving passageway.

9. An electrical connector of claim 8, wherein said insulative housing comprises a latch extending into the envelope of the terminal receiving passageway, and said sealing plug has a surface for engagement with said latch.

10. An electrical connector of claim 6, wherein said sealing member is an wire seal comprising a plurality of openings aligned with the plurality of terminal receiving passageways.

11. An electrical connector of claim 10, wherein said sealing plug has an extension portion extending beyond said sealing member.

12. An electrical connector of claim 11, wherein said extension portion has a finger grip for gripping said sealing plug.

13. An electrical connector profiled for connection with a complementary connector, the electrical connector comprising:

an insulative housing having a plurality of terminal receiving passageways extending between a mating face and a conductor exit face;

a plurality of electrical terminals positioned in at least some of said plurality of terminal receiving passageways, leaving at least one terminal receiving passageway empty;

a sealing member positioned adjacent said plurality of terminal receiving passageways and having apertures to receive insulated conductors thereto and seal an interior of the terminal receiving passageways;

an electrical shunt member positioned adjacent to at least two of said terminal receiving passageways; and an insulating plug, profiled to be received in said at least one empty terminal receiving passageway, and profiled to deflect said shunt member from a shunted to un-shunted position when received therein.

14. An electrical connector of claim 13, wherein said shunt member comprises at least one shunt contact which extends into the envelope of the terminal receiving passageway, and a front end portion of said sealing plug deflects said engagement portion, and said shunt downwardly to deflect said shunt from a shunted to un-shunted position when received therein.

15. An electrical connector of claim 13, wherein said sealing plug is profiled for latching within said terminal receiving passageway.

16. An electrical connector of claim 15, wherein said insulative housing comprises a latch extending into the envelope of the terminal receiving passageway, and said sealing plug has a surface for engagement with said latch.

17. An electrical connector of claim 13, wherein said sealing member is an wire seal comprising a plurality of openings aligned with the plurality of terminal receiving passageways.

18. An electrical connector of claim 17, wherein said sealing plug has an extension portion extending beyond said sealing member.

19. A sealing plug for receipt within an empty terminal receiving passageway of a sealed electrical connector, comprising an elongate body profiled to be received in at least one empty terminal receiving passageway, said sealing plug comprising a sealing section that fills the void of the sealing member aperture of the at least one empty terminal receiving passageway, and said elongate body profiled to extend to a position adjacent to a mating face of the sealed electrical connector.

* * * * *